US007128619B1

(12) United States Patent
Muench, Jr.

(10) Patent No.: US 7,128,619 B1
(45) Date of Patent: Oct. 31, 2006

(54) CONNECTOR SYSTEM AND METHOD FOR SECURING A CABLE IN A CONNECTOR SYSTEM

(75) Inventor: Frank J. Muench, Jr., Waukesha, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/981,568

(22) Filed: Nov. 5, 2004

(51) Int. Cl.
*H01R 4/36* (2006.01)

(52) U.S. Cl. ..... 439/810

(58) Field of Classification Search ..... 439/781, 439/782, 783, 877, 63, 810, 811, 812
See application file for complete search history.

(56) References Cited

U.S. PATENT DOCUMENTS

| | | | | | |
|---|---|---|---|---|---|
| 3,794,963 | A | * | 2/1974 | Cooper, Jr. | 439/798 |
| 3,983,314 | A | * | 9/1976 | Filhaber | 174/138 F |
| 4,214,806 | A | * | 7/1980 | Kraft | 439/620 |
| 4,738,009 | A | * | 4/1988 | Down et al. | 29/33 M |
| 4,758,171 | A | | 7/1988 | Hey | |
| 4,791,245 | A | | 12/1988 | Thornley | |
| 4,889,006 | A | * | 12/1989 | Kolinske et al. | 74/502.4 |
| 5,059,747 | A | | 10/1991 | Bawa et al. | |
| 5,533,913 | A | * | 7/1996 | Boehm et al. | 439/810 |
| 5,595,505 | A | * | 1/1997 | Duke et al. | 439/630 |
| 5,692,930 | A | * | 12/1997 | Garver et al. | 439/781 |
| 5,804,767 | A | | 9/1998 | Winfield et al. | |
| 5,865,654 | A | | 2/1999 | Shimirak et al. | |
| 5,900,585 | A | | 5/1999 | Winfield et al. | |
| 5,931,708 | A | * | 8/1999 | Annas et al. | 439/798 |
| 5,951,327 | A | | 9/1999 | Marik | |
| 5,952,612 | A | | 9/1999 | Winfield et al. | |
| 6,089,913 | A | | 7/2000 | Holliday | |
| 6,231,404 | B1 | | 5/2001 | Lichy | |
| 6,299,485 | B1 | | 10/2001 | Marik | |
| 6,347,967 | B1 | * | 2/2002 | Tamm | 439/806 |
| 6,579,131 | B1 | * | 6/2003 | Ashcraft et al. | 439/798 |
| 6,939,183 | B1 | * | 9/2005 | Ferretti et al. | 439/798 |
| 6,971,926 | B1 | * | 12/2005 | Walton | 439/798 |
| 2003/0092325 | A1 | * | 5/2003 | Schad et al. | 439/877 |
| 2005/0202732 | A1 | * | 9/2005 | Rizzo et al. | 439/810 |

OTHER PUBLICATIONS

"Multi-Tap Insulated Multiple Cable Connector Blocks," Panduit, Product Bulletin, 1999 Panduit Corp., 4 pages.
"EPKB Heat-shrinkable medium voltage branch joints for single core polymeric cables up to 36 kV," Raychem, Product Bulletin, Jun. 1998, 4 pages.
"Power Connector Systems," FCI, Product Bulletin, Feb. 2002, 24 pages.
PCT International Search Report (International Application No. PCT/US05/39662), Jan. 24, 2006, 9 pages.

* cited by examiner

*Primary Examiner*—Chandrika Prasad
(74) *Attorney, Agent, or Firm*—Fish & Richardson P.C.

(57) ABSTRACT

A connector system includes a member having a surface with an opening in the surface and an open end defined by one or more walls, where the walls include a first end attached to the surface and a second end having a notch. The connector system further includes a contact element defined by a passage in an axial direction and an opening that is perpendicular to the passage, where the contact element is sized to fit within the open end of the member such that the notch in the second end of the walls aligns with the passage in the contact element. The connector system also includes a probe element connectable to the opening in the surface of the member and the opening of the contact element.

39 Claims, 11 Drawing Sheets

CONNECTOR SYSTEM AND METHOD FOR SECURING A CABLE IN A CONNECTOR SYSTEM

TECHNICAL FIELD

This document relates to electrical connectors for electrical terminators with elastomeric insulation.

BACKGROUND

Electrical connectors terminate and connect a variety of cables that carry electrical power and/or signals. The cables come in many different sizes.

SUMMARY

In one general aspect, a connector system includes a member having a surface with an opening in the surface and an open end defined by one or more walls, where the walls include a first end attached to the surface and a second end having a notch. The connector system further includes a contact element defined by a passage in an axial direction and an opening that is perpendicular to the passage, where the contact element is sized to fit within the open end of the member such that the notch in the second end of the walls aligns with the passage in the contact element. The connector system also includes a probe element connectable to the opening in the surface of the member and the opening of the contact element.

Implementations may include one or more of the following features. For example, the notch may form a U-shaped notch or a V-shaped notch. The opening in the contact element may be threaded to receive the probe element. The probe may include a main portion and a threaded portion with the threaded portion having a diameter smaller than the main portion, where the threaded portion is inserted through the opening in the surface of the member, and the main portion mates with the surface of the member.

The member, the contact element, and the probe element may be made of electrically conductive material. The passage in the contact element may be sized to accept a variety of different sizes of cable.

The connector system may further include a terminator having an opening to receive the member, the contact element, and the probe.

The probe element may include a contact pad that is attached to the end of the threaded portion of the probe element.

In another general aspect, securing a cable in a connector system to form multiple current carrying paths includes receiving a cable through a passage in a contact element and an open end of a member defined by one or more walls, where the walls include an end having a notch. A probe element is inserted through an opening in the member and an opening in the contact element that is perpendicular to the passage and the probe element is rotated to move the contact element and the member together to capture the received cable between the passage in the contact element and the notch in the open end of the member to form multiple current carrying paths.

Implementations may include one or more of the following features. For example, the contact element, the probe element, and the member may be made of electrically conductive material. The probe element may be threaded through the opening in the contact element. The notch may include a U-shaped or a V-shaped notch.

In another general aspect, a connector system includes a connector having an inner surface defined by a passage in an axial direction, the connector including one or more openings that are perpendicular to the passage. The connector system further includes one or more contact elements disposed to fit through the openings of the connector to capture a cable inserted in the passage of the connector between the edges of the contact elements and the surface of the connector.

Implementations may include one or more of the following features. For example, the inner surface may include one or more cuts opposite the openings. At least one of the contact elements may have a notch on one side. The notch may include a U-shaped notch or a V-shaped notch. An inside diameter of the notch and an inside diameter of the inner surface of the connector may be about the same diameter.

The contact elements may be about the same size as the openings in the connector. The contact elements may be tapered and larger than the openings in the connector.

The connector system may further include one or more bolts to drive the contact elements through the openings of the connector and across the passage of the connector to capture the cable. The openings of the connector may be threaded and the bolts may include threads having one or more tapered undercuts in the threads.

The connector system may further include a hydraulic die or a manual tool to drive the contact elements through the openings of the connector and across the passage of the connector to capture the cable. The contact elements may be tapered to lock the contact elements in place.

The connector may be sized to accept a variety of different sizes of cable.

In another general aspect, securing a cable in a connector system includes receiving a cable through a passage in an axial direction of a connector, inserting one or more contact elements through one or more threaded openings of the connector that are perpendicular to the passage, and inserting one or more threaded bolts into the threaded openings of the connector to drive the contact elements across the passage of the connector to capture the received cable.

Implementations may include one or more of the following features. For example, the threaded bolts may include a tapered undercut to shear the bolts at the undercut. At least one of the contact elements may include a notch. The notch may be a U-shaped notch or a V-shaped notch. An inside diameter of the notch and an inside diameter of an inner surface of the connector may be about the same diameter.

In another general aspect, securing a cable in a connector system includes receiving a cable through a passage in an axial direction of a connector, inserting one or more contact elements through one or more openings of the connector that are perpendicular to the passage, and using a hydraulic die or a manual tool to drive the contact elements through the opening of the connector and across the passage of the connector to capture the cable.

Implementations may include one or more of the following features. For example, the hydraulic die or the manual tool may be used to apply force to the contact elements and only a portion of the connector. At least one of the contact elements may include a notch. The notch may include a U-shaped notch or a V-shaped notch. An inside diameter of the notch and an inside diameter of an inner surface of the connector may be about the same diameter.

Other features will be apparent from the description and drawings, and from the claims.

DESCRIPTION OF DRAWINGS

Like reference symbols in the various drawings indicate like elements.

DETAILED DESCRIPTION

Figure 1:
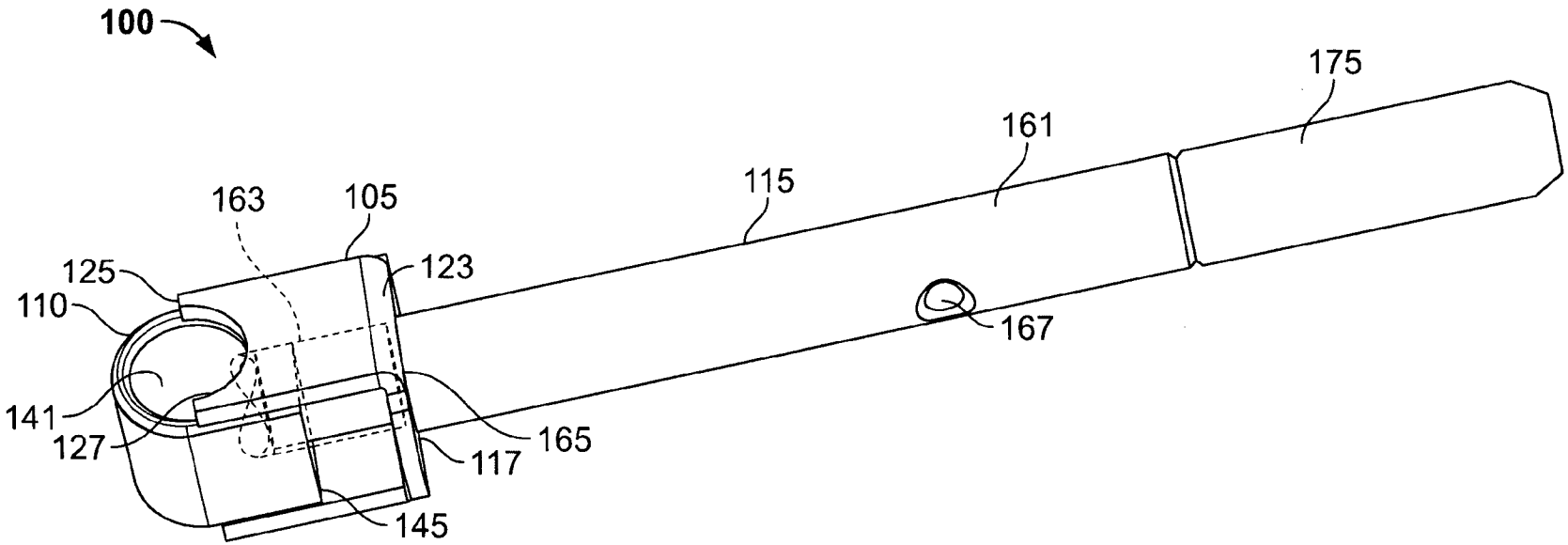
FIG. 1 is a perspective view of a connector system.

Referring to FIG. 1, a connector system 100 includes a member 105, a contact element 110, and a probe element 115. The contact element 110 is sized to fit within an open end of the member 105, and may move within the member 105. The probe element 115 passes through and mates against the member 105 and connects to the contact element 110. In one implementation, the member 105, the contact element 110, and the probe element 115 are made of an electrically conductive material, such as copper or a copper alloy.

In one exemplary implementation, an optional arc follower 175 may be included as part of the connector system 100. For instance, arc follower 175 may be attached to the probe element 115 when the connector system 100 is to be used in a loadbreak terminator.

A cable (not shown) may be inserted into a passage 141 in the contact element 110. With the cable in place, the probe element 115 may be rotated and tightened to cause the member 105 and the contact element 110 to move together. As the member 105 and the contact element 110 move together, the cable is captured between the member 105, the contact element 110, and the end of the probe element 115. The connection of the cable between the member 105, the contact element 110, and the end of the probe element 115 forms multiple, effective current carrying paths that can be used with a wide range of cable sizes. In one implementation, for example, the connector system 100 may be used with stranded and/or solid conductors including cable sizes #6 through 4/0. Using the same connector system 100 for a variety of cable sizes reduces the inventory of the number of different connector systems that are required for the different cable sizes. In the past, one connector system may have only been used with one or two different cable sizes, thus requiring a larger inventory of different connectors.

Figure 2:
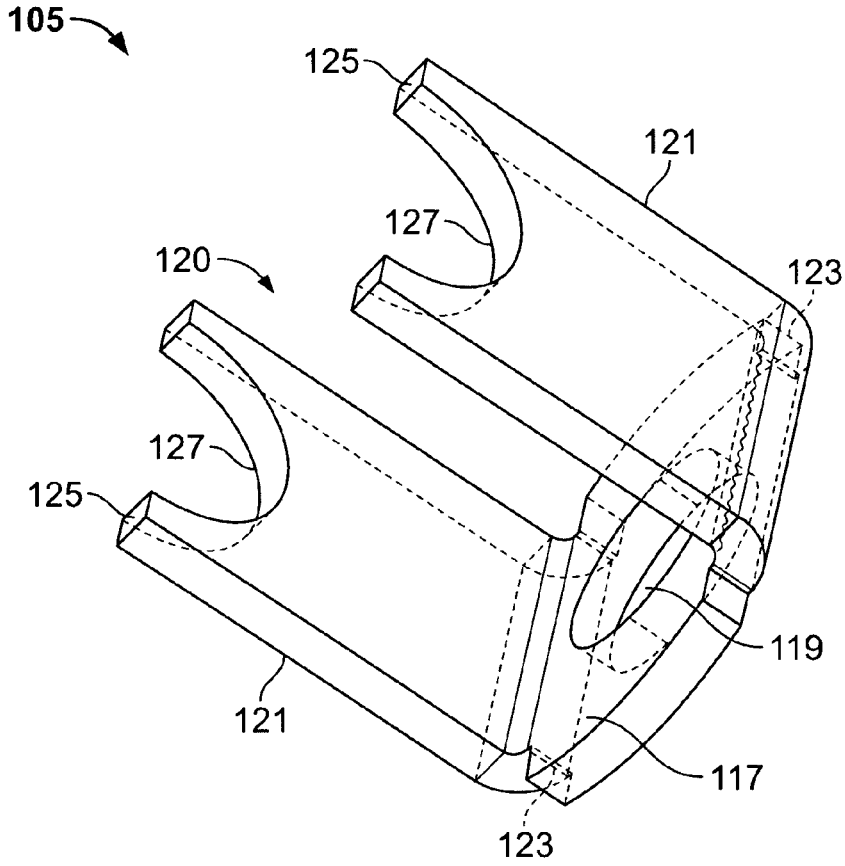
FIG. 2 is a perspective view of a member of the system of FIG. 1.

Referring also to FIG. 2, the member 105 includes a surface 117 having an opening 119 and an open end 120 defined by one or more walls 121. Each of the walls 121 includes a first end 123 attached to the surface 117 and a second end 125 having a notch 127. In one implementation, the notch 127 is U-shaped and positioned to align with the passage 141 in the contact element 110. In other implementations, the notch 127 may have another shape. For example, the notch 127 may be V-shaped.

Figure 3:
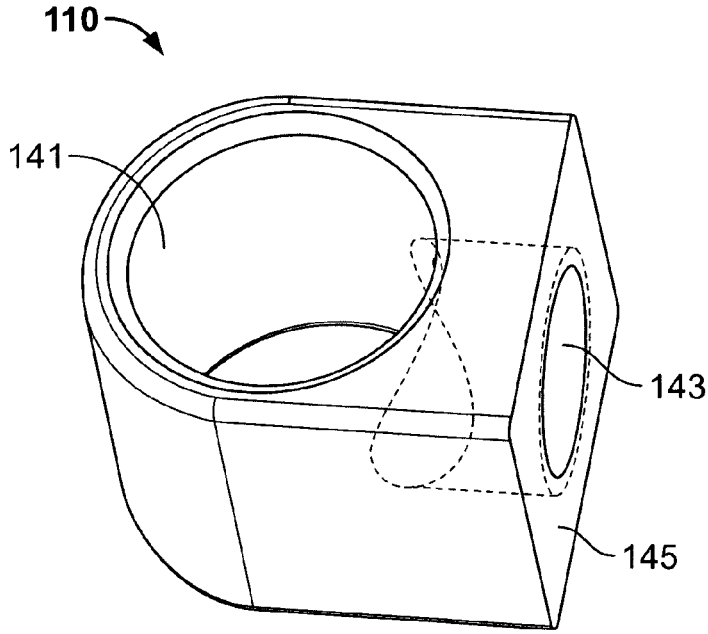
FIG. 3 is a perspective view of a contact element of the system of FIG. 1.

Referring also to FIG. 3, the passage 141 of the contact element 110 extends in an axial direction. The contact element 110 also includes an opening 143 that is perpendicular to the passage 141. The contact element 110 typically is sized to fit within the open end 120 of the member 105 to allow the contact element 10 and the member 105 to move together. The contact element 110 may be referred to as a "moving" contact element because it is able to move within the open end 120 of the member 105. The passage 141 is used to receive a stranded or a solid electrical conductor. The opening 143 extends from the outside surface 145 of the contact element through the contact element to the passage 141. In one implementation, the opening 143 is threaded to receive the probe element 115.

Figure 4:
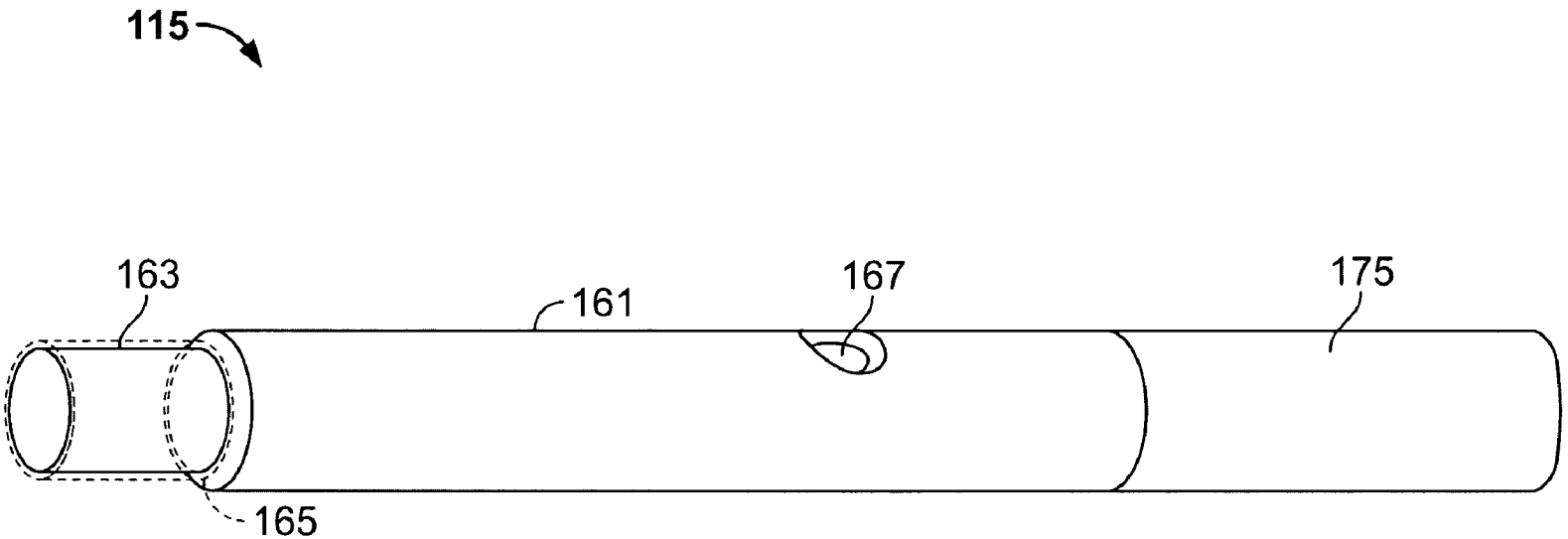
FIG. 4 is a perspective view of a probe element of the system of FIG. 1.

Referring also to FIG. 4, the probe element 115 includes a main portion 161 and a threaded portion 163. The main portion 161 has a diameter that is larger than the threaded portion 163. The threaded portion 163 is inserted through the opening 119 in the surface 117 of the member 105. The exposed surface of the outside diameter of the main portion 165 mates with the surface 117 of the member 105. After being inserted through the opening 119 in the surface 117 of the member 105, the threaded portion 163 is inserted into the threaded opening 143 of the contact element 110. A hole 167 extends through the probe element 115 and is used in securing the connector system 110.

An optional arc follower 175 may be connected to the main portion 161 of the probe element 115. The arc follower 175 may be used when the probe element 115 is used in a loadbreak terminator. For instance, the arc follower 175 may be made of plastic to enable the connector system to be separated while the connector system is energized and carrying load. Otherwise, without plastic arc follower 175 attached, the connector system may not be separated safely while it is energized and carrying load.

Figure 5:
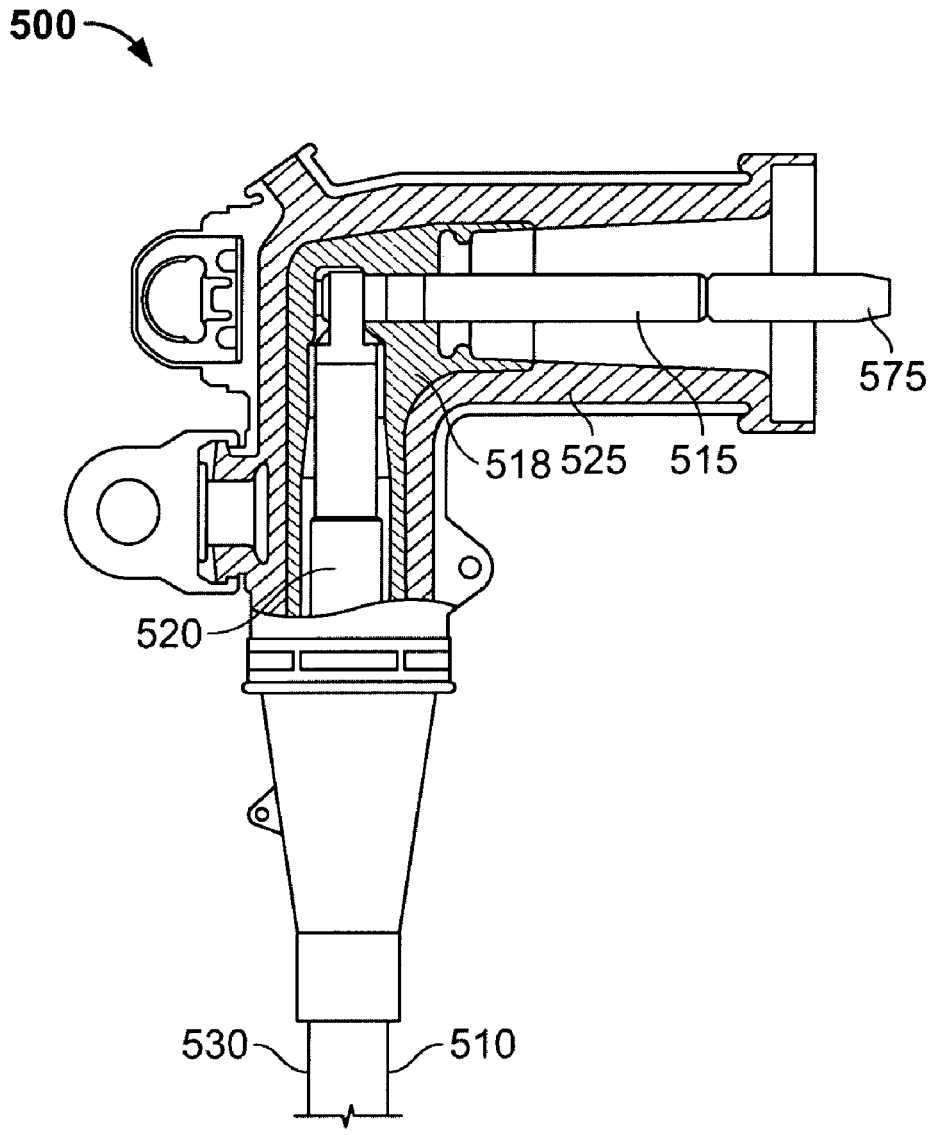
FIG. 5 PRIOR ART
FIG. 5 is a sectional view of a conventional connector inserted into an elbow terminator.

FIG. 5 shows a typical elbow terminator 500 in conjunction with a normal connector and a cable 510. The elbow terminator 500, which may be molded from EPDM rubber, has at least three layers. One layer is the conductive internal stress relief insert 518. Another layer includes the cable insulation 520, which provides electrical insulation and isolation between the conductive parts. The outside layer is a conductive layer 525 that drains away capacitive current and maintains ground potential on the exterior of the terminator 500.

In present designs, the cable 500 may be prepared by removing the outer conductive ground shield 530 of the cable to expose a specified length of the cable insulation 520. The cable insulation 520 is removed, in turn, along with the conductive strand shield for a predetermined length to expose the wire of the cable.

In the implementation illustrated in FIG. 5, the prepared wire of the cable is inserted into a conventional connector that may include a probe element 515 and an optional arc follower 575. The connector system may be fixed in placed using hydraulic or manual tools, compressing the barrel against the wire of the cable. The connector system is then pushed into the terminator body so as to reside in the internal stress relief insert. The insert keeps all air within the energized portion of the elbow at the same potential and thereby prevents electrical discharges from occurring, as such discharges could damage the elbow terminator 500 or cable 510. The probe element 515, with or without an optional arc follower 575, is inserted into the elbow terminator 500 at a right angle to the cable. The top portion of the connector has threads that mate with a threaded portion of the probe element 515. The probe element 515 may be tightened with a wrench that bends at a predetermined torque to secure the cable and terminator together. In this case, the operator aligns the probe element and the connector to prevent cross threading and to ensure the probe element 515 is correctly aligned to allow mating with a bushing (not shown).

Where connector system 100 is used, the connector system is installed in the stress relief insert of the elbow with the probe element 115 mounted into the connector when the elbow terminator leaves the factory. In this case, the cable is prepared and pushed into the elbow, and the probe element 115 is tightened to secure the cable and the probe 115 into place. By installing the connector system 100 in the factory, the need for compressing the outer diameter of the wire connector is eliminated. In addition, field personnel do not need to take the care needed to line up the threads of the probe 115 and the connector 100 to prevent cross threading and other damage to the threads.

In one implementation, a separate system may be used to hold the contact element 110 in position relative to the member 105 and the probe element 115. For instance, a washer (not shown) or an interruption (not shown) in the threaded portion 163 of the probe element 115 may be used to hold the elements of the connector system 100 in place.

Figure 6:
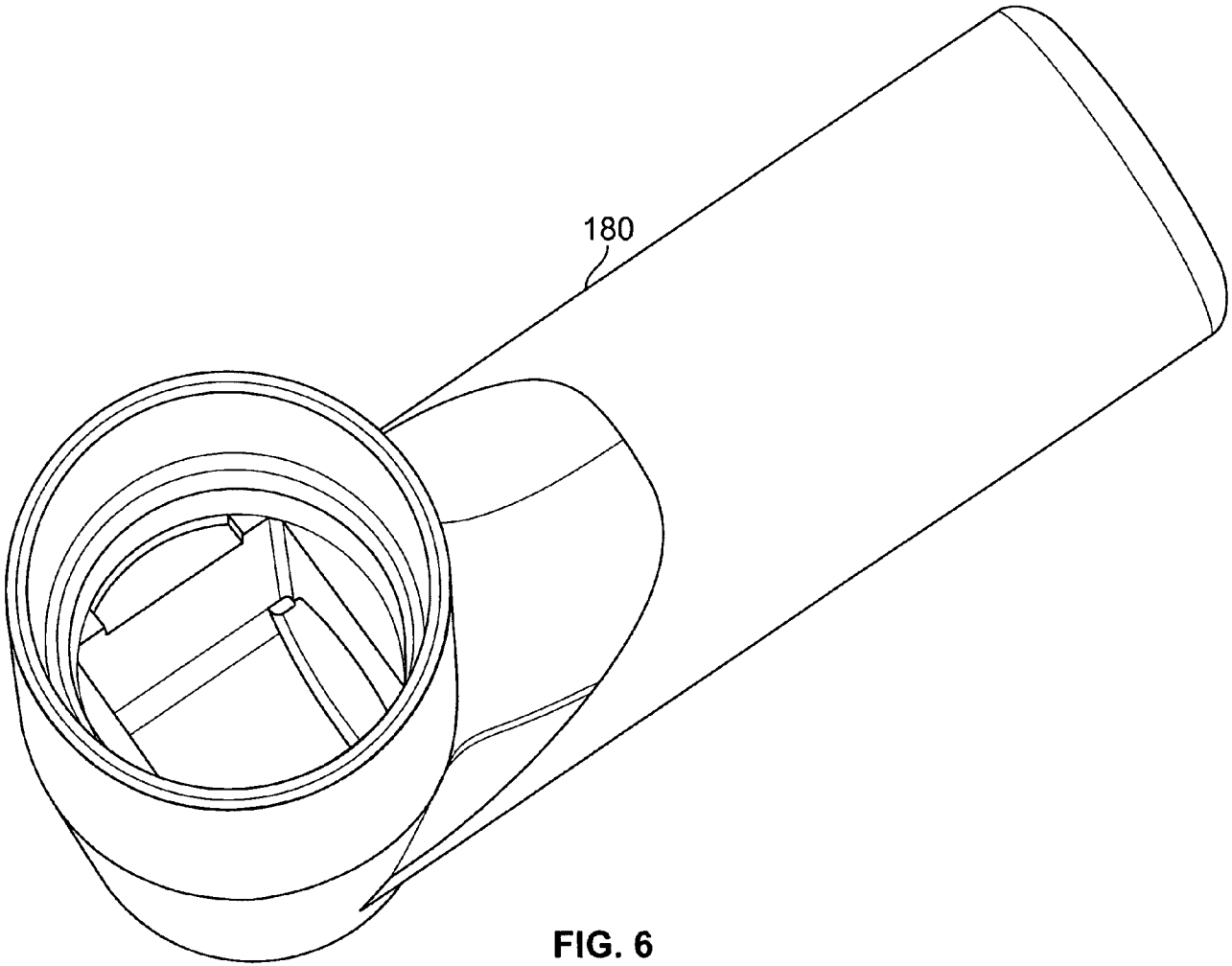
FIG. 6 is a perspective view of a conductive insert of a terminator into which the connector system of FIG. 1 may be inserted.

FIG. 6 illustrates a modified stress relief insert used in elbow termination. This insert may be molded into the elbow terminator in the same location as a standard insert. As shown, the connector system 100 (not shown in FIG. 5) is inserted into the opening in the conductive insert 180, which is inserted inside a terminator. The connector system 100 may be secured in the terminator in numerous different ways. For example, the connector system 100 may be secured in the terminator by a snap fit, by using double-sided tape adhesives, or by other means such as a separate insulating member that may be molded, glued, snapped, or locked into place. The connector system 100 is positioned so that the passage 141 of the contact element 110 and the notches 127 on the walls 121 of the member 105 are approximately colinear with the opening in the terminator that accepts the cable.

In one implementation, the connector system 100 may be used in elbows that have continuous current ratings of 200 A or lower, which typically includes cables with a diameter ranging from #6 wire through #4/0 wire.

Prior to inserting the cable in the connector system 100, the cable may be prepared by removing appropriate lengths of any neutral system, and the outer conductive jacket that surrounds insulation of the cable. The exposed insulation is then removed to the appropriate length to expose the wire. The cable is pushed into the terminator with the wire going through the passage 141 of the contact element 110.

Figure 7:
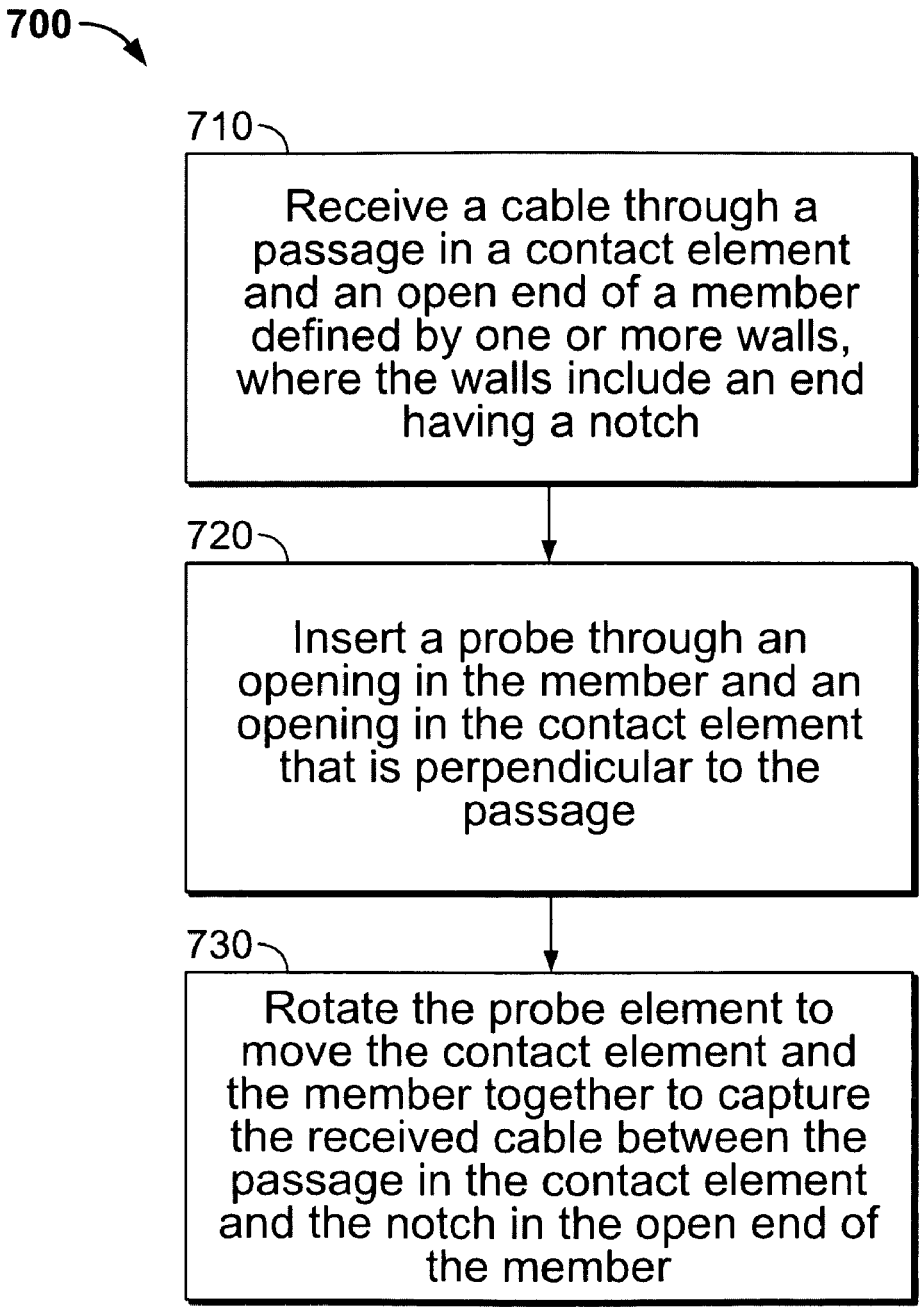
FIG. 7 is a flow chart of a process for securing a cable in the connector system of FIG. 1.

Referring to FIG. 7, a process 700 for securing a cable in the connector system 100 includes receiving the cable through the passage in the contact element and an open end of the member that is defined by one or more walls, where the walls include an end having a notch (step 710). With the cable in place, the probe is inserted through the opening in the member and the opening in the contact element that is perpendicular to the passage (step 720). The probe element is rotated to move the contact element and the member together to capture the received cable between the passage in the contact element and the notch in the open end of the member (step 730).

The system simplifies the current interchange between the wire of the cable and the probe element 115, which may mate with bushing contacts or the flat surface of the bushing contact tube, and thereby improves the current carrying ability of the system. The system also eliminates sharp edges that may form during the installation of the connector on the wire, making it easier to insert cable into the terminator and ensuring that the cable entrance of the terminator is not damaged during the insertion process.

Figure 8:
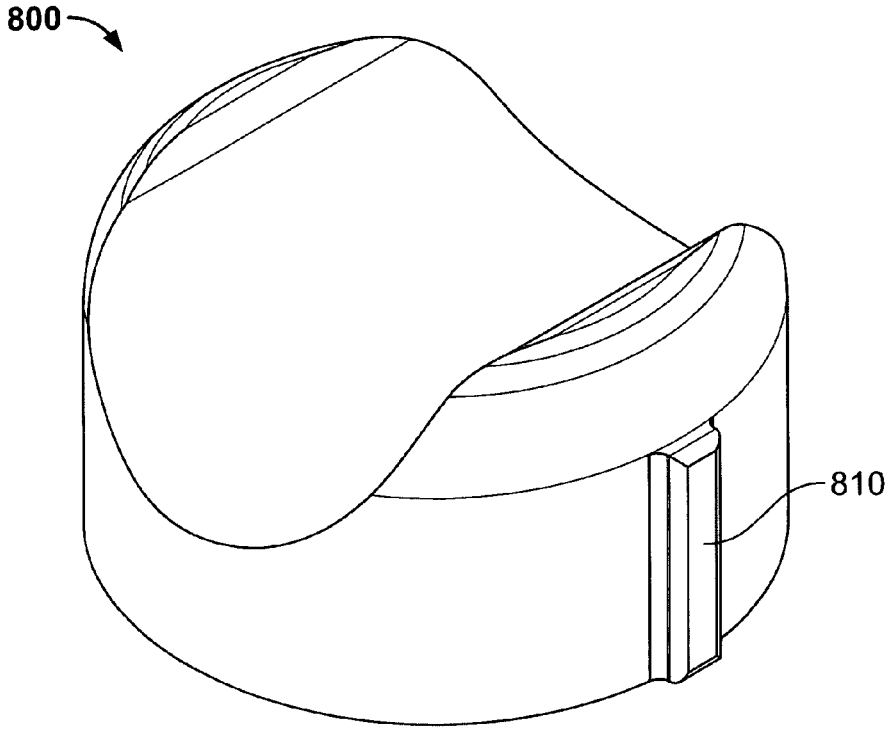
FIG. 8 is a perspective view of a contact pad.

Referring to FIG. 8, another implementation of the probe element 115 includes a contact pad 800 at the end of the threaded portion 163. The contact pad 800 may be placed on the end of the threaded portion 163 after the probe element 115 has been inserted through the member 105 and partially threaded through the threaded opening 143 of the contact element 110. When the probe element 115 having the contact pad 800 is rotated, the contact pad 800 increases the conductive surface area between the cable and the end of the probe element 115, thus improving the current carrying capability of the connector system 100. The contact pad 800 includes a raised extrusion 810 on the outside diameter. The raised extrusion 810 is used to mate with a slot cut into the threads to control the orientation of the contact pad 800 with respect to the cable.

Referring also to FIG. 2, in another exemplary implementation, member 105 may include threads cut on the inner diameter defining opening 119. The end of the threaded portion 163 would mate with the threads of the member 105. The member 105 may be formed from a tube that is flattened on one side, where the threads are cut. As the probe element 115 is tightened with the flattened tube that forms member 105, the back of the threaded portion moves toward the back of the flattened tube, thus, reducing the distance and capturing the wire between the end of the threaded portion 163 and the back of the flattened tube, which makes an electrical connection. A contact pad 800 may be placed between the end of the threaded portion 163, the cable and the back of the flattened tube to help lock the elements together and improve the electrical and mechanical connection.

Figure 9:
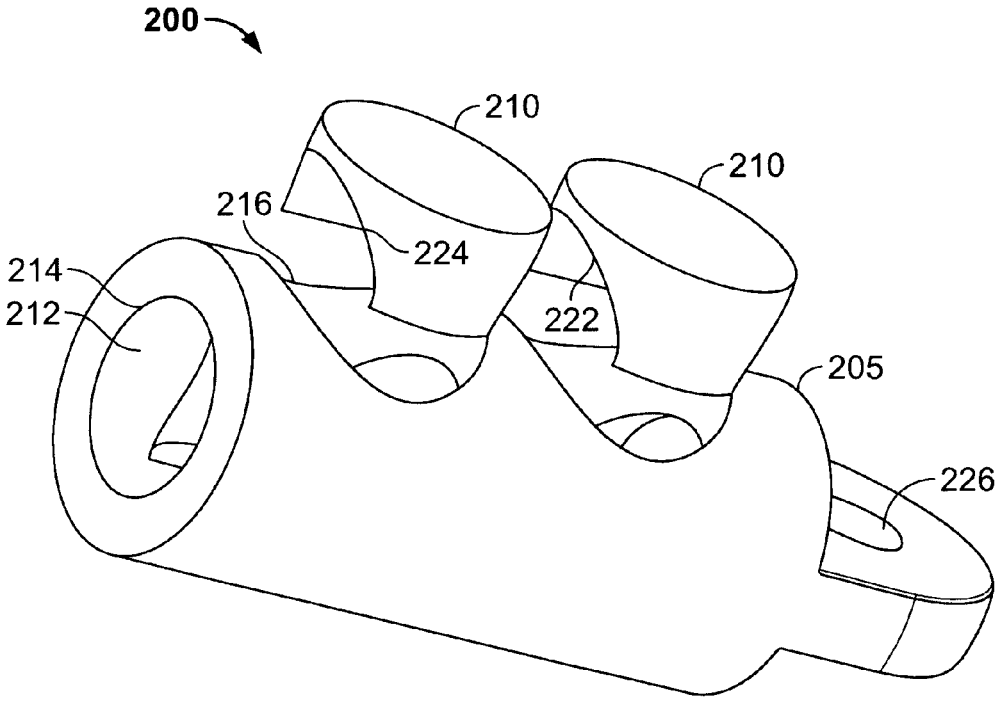
FIG. 9 is an exploded perspective view of a connector system.

Referring to FIG. 9, a connector system 200 includes a connector 205 and two contact elements 210. The connector 205 and the contact elements 210 are made of electrically conductive material. The connector 205 includes an inner surface 212 defined by a passage 214 in an axial direction. The connector 205 also includes two openings 216 that are perpendicular to the passage 214. The openings 216 extend from the outer diameter of the connector 205 and through the connector wall to the intersection with the passage 214. The inner surface 212 may include cuts in the surface opposite the openings 216.

The contact elements 210 are sized to fit within the openings 216 of the connector 205. In one implementation, the contact elements 210 are about the same size as the openings 216. In another implementation, the contact elements 210 are tapered and slightly larger than the openings 216. The contact elements 210 capture a cable (not shown) inserted into the passage 214 on the edges 222 of the contacts elements. Each contact element 210 includes a notch 224 cut out of one side of the contact element. In one exemplary implementation, the notch is U-shaped.

Figure 10:
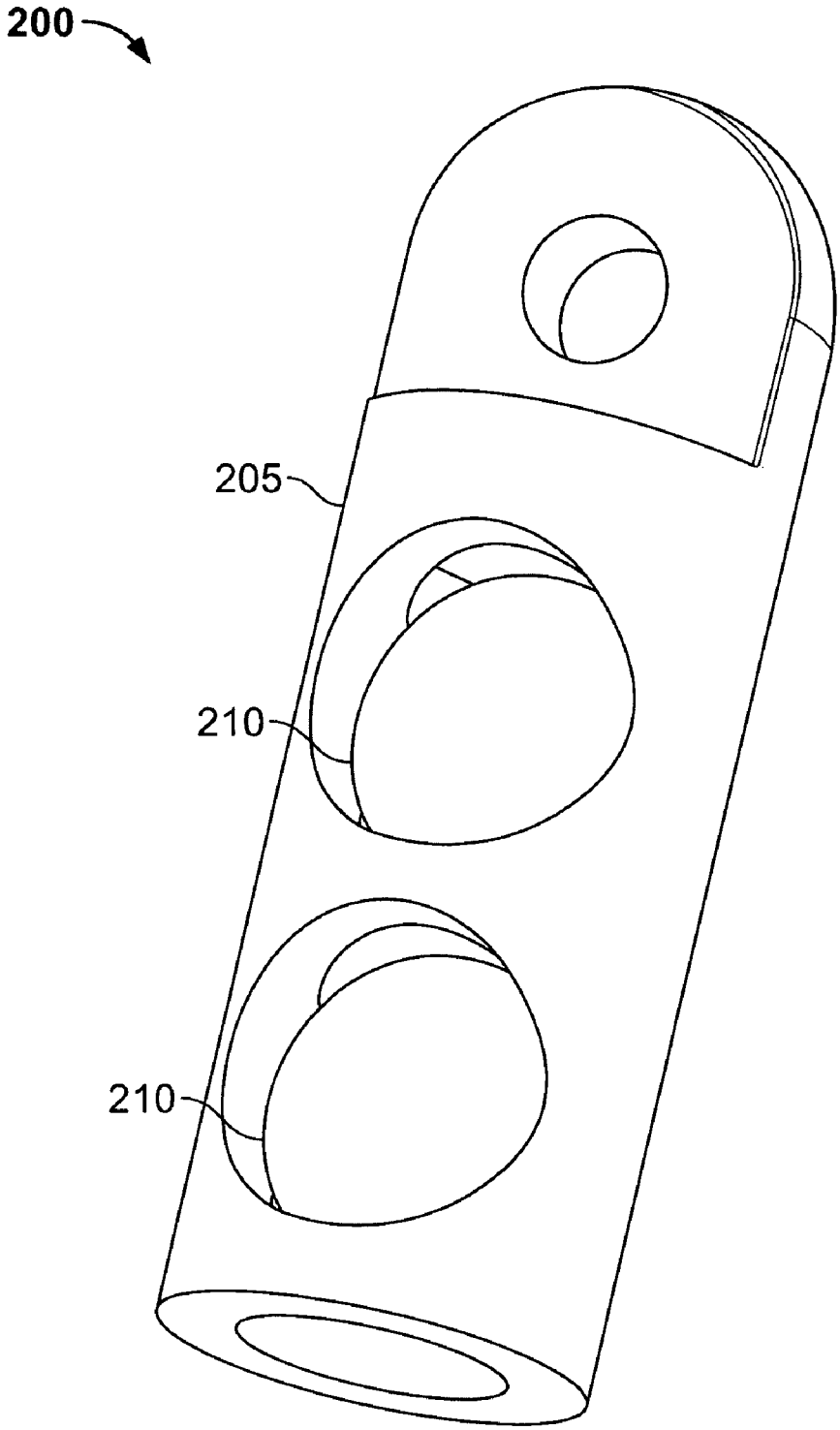
FIG. 10 is a perspective view of a component of the connector system of FIG. 9.

The contact elements 210 are driven through the openings 216 and across the passage 214 of the connector 205. The contact elements 210 capture the cable between the opposite side of the openings 216 of the connector 205 and the edges 222 of the contact elements 210 to form multiple current carrying paths that allow the cable to be solidly connected to the connector 205 so that the full rating of the conductor is maintained through the connector 205. FIG. 10 illustrates the connector system 200 with the contact elements 210 in the lowest position within the connector 205.

The connector 205 also includes a mechanism for connecting the connector 205 to another device. In the illustrated implementation, the connector 205 includes a bolt opening 226 to bolt the connector 205 against the face of a bushing (not shown) to form the current interchange between the connector 205 and the bushing.

In one implementation, the wide-ranging connector system 200 may be used with stranded and/or solid conductors including cable sizes ranging from #2 solid wire through 1000 MCM. In this example, the range of cable sizes includes diameters ranging from 0.26 inches to over 1.15 inches.

Figure 11:
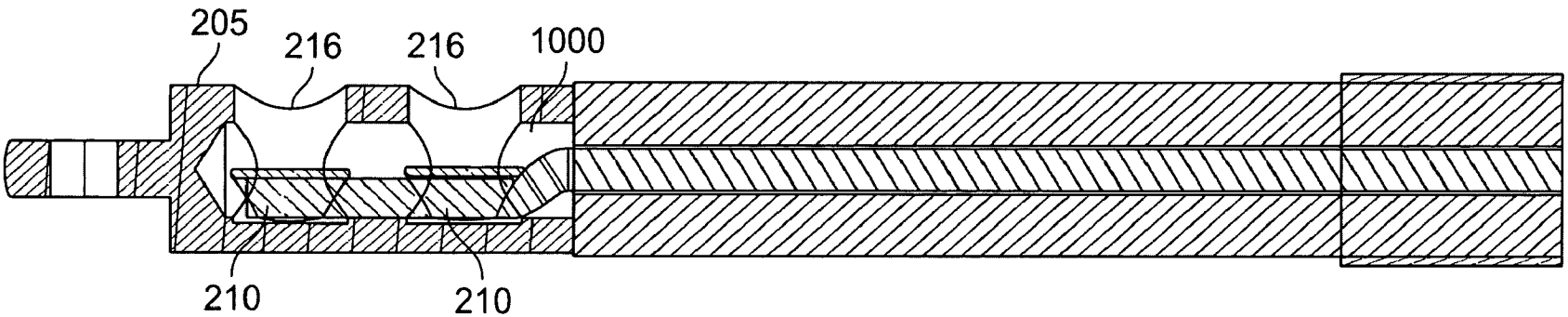
FIG. 11 is a sectional view of the connector system of FIG. 9 with a cable secured in the connector system.

FIG. 11 provides a sectional view of a cable 1000 inserted into the connector 205. When the holes 216 are machined into the connector 205, a cut surface on the far side of the opening 212 may be created. As an alternative, grooves may be machined into the opening 212 to create a similar cross-sectional cut. As the movable contacts 210 are forced through the opening 216, the cable conductor is deformed by the movable contacts 210 and pushed against the far side of the connector barrel opening 212. This creates a sound electrical contact that is augmented by the cuts or grooves, which also increase pull-out forces of the cable.

Figure 12:
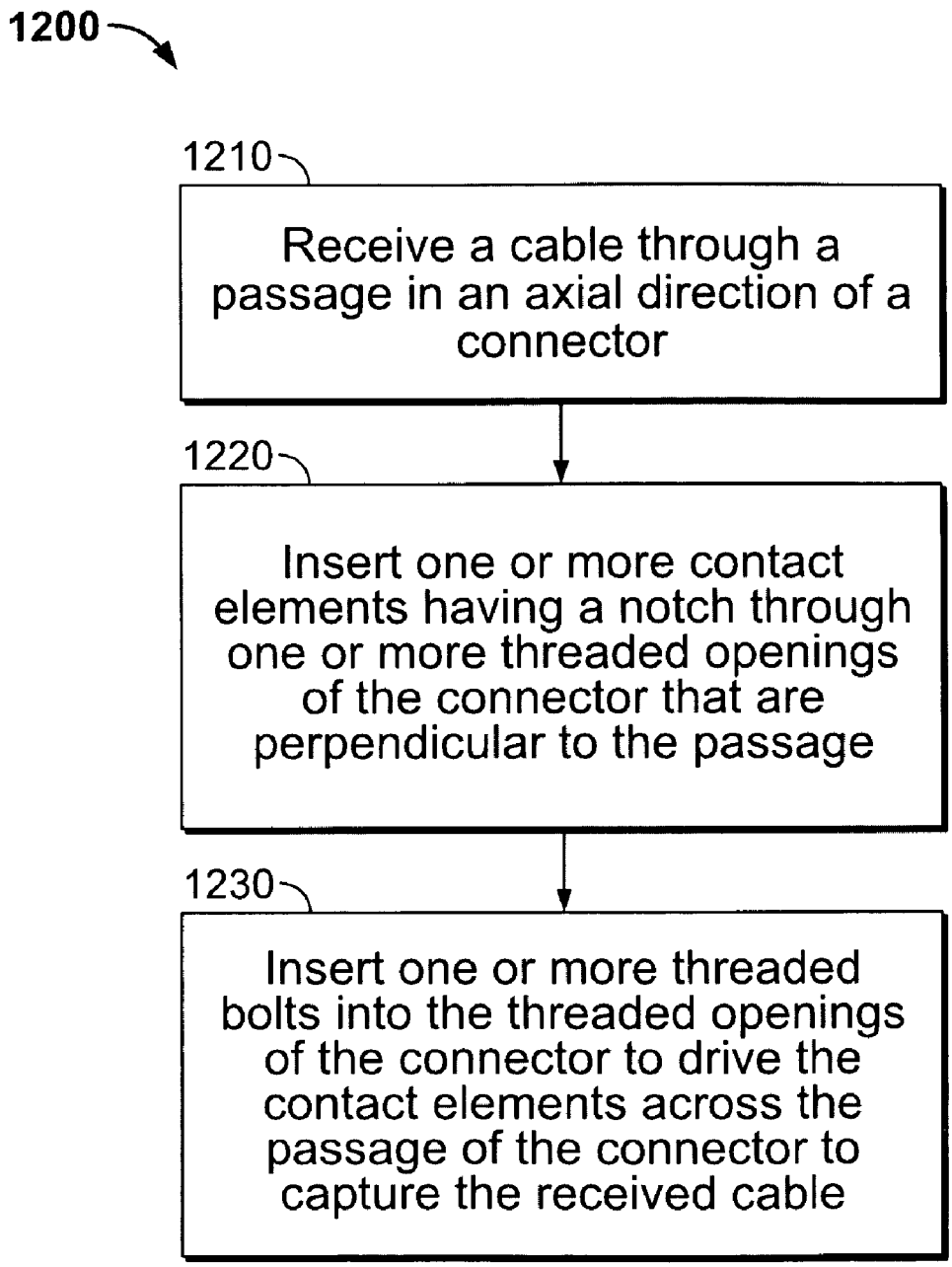
FIGS. 12 and 13 are flow charts of exemplary processes for securing a cable in the connector system of FIG. 9.

Referring to FIG. 12, a process 1200 for securing a cable in a connector system includes receiving a cable through a passage in an axial direction of a connector (step 1210). Contact elements having notches are inserted through threaded openings of the connector that are perpendicular to the passage of the connector (step 1220). Then, threaded bolts are inserted into the threaded openings of the connector to drive the contact elements across the passage of the connector to capture the received cable (step 1230). Unlike past systems where electrical contact was made between the bolts, the cable, and the connector, in this process the electrical contact is made between the contact elements, the cable, and the connector. This improves the centering of the cable in the connector and more effectively captures the cable between the contact elements and the connector to improve the current carrying capability of the connector.

In one implementation, each threaded bolt includes one or more undercuts in the threads. The undercuts in the threads may be tapered so that the undercuts towards the bottom of the bolt are larger than those near the head of the bolt. As the bolt is tightened, the stress on the bolt increases and eventually the bolt breaks at the undercut. Since the undercuts are deeper toward the bottom of the bolt, the bolts typically shears off close to the connector body.

Figure 13:
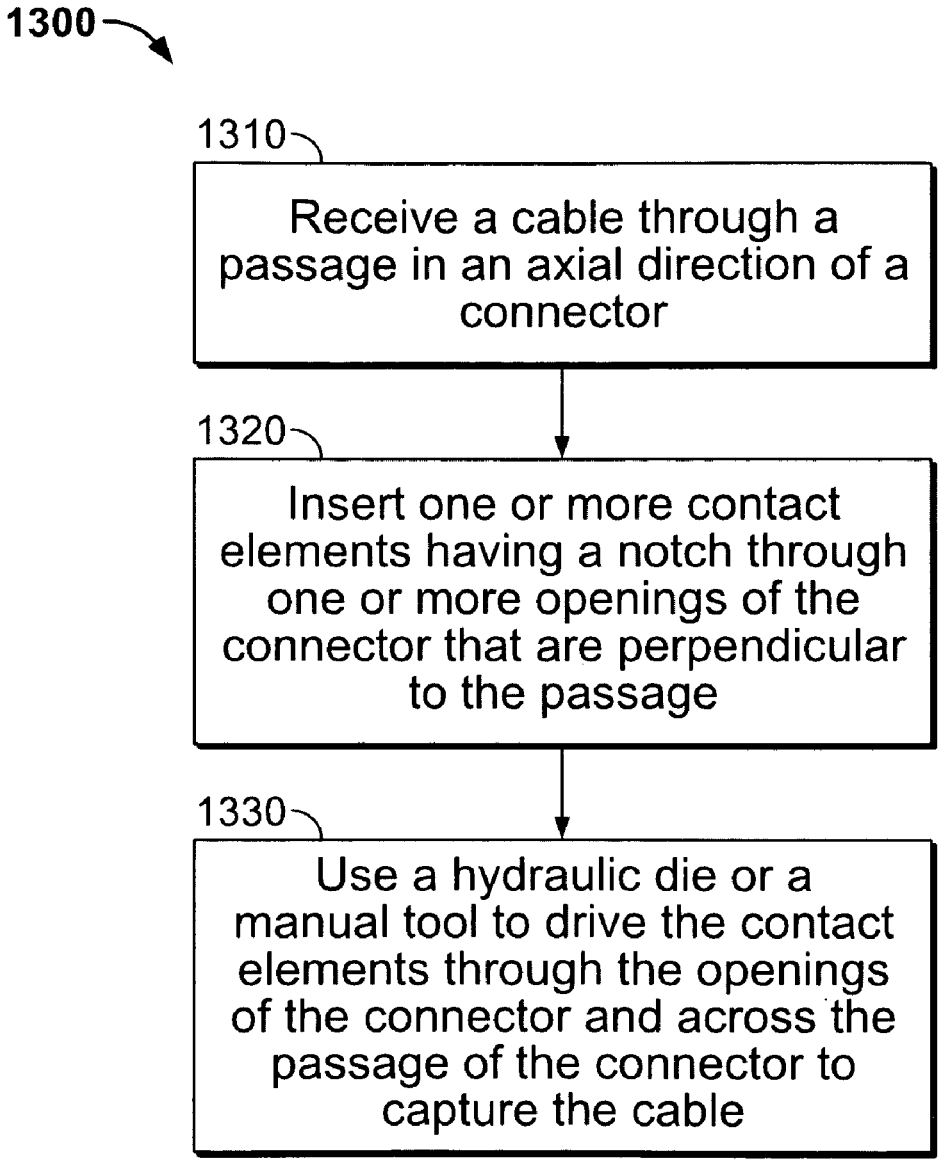

Referring to FIG. 13, a process 1300 for securing a cable in a connector system includes receiving a cable through a passage in an axial direction of a connector (step 1310). Contact elements having notches are inserted through one or more openings of the connector that are perpendicular to the passage of the connector (step 1320). A hydraulic die or a manual tool is used to drive the contact elements through the openings of the connector and across the passage of the connector to capture the cable (step 1330). In one implementation, a manual tool (e.g., a crimping tool) may be used to amply the force and drive the contact elements through the openings of the connector and across the passage to capture the cable. In one implementation, the contact elements are tapered so that the portion closest to the outside of the connector has a larger outside diameter than the lower portion that captures the cable. The tapering of the contact elements causes the contact elements to be locked into place.

In another implementation, the hydraulic die or the manual tool is used to collapse the opening of the connector as the contact element is driven through the opening and across the passage. Collapsing the opening also causes the contact element and the cable to be locked into place.

In the past, dies have been used to reshape and collapse the entire connector onto the cable. To accomplish collapsing the entire connector onto the cable, the dies must move across the entire cross section of the connector, which requires large amounts of force, thus limiting the total movement of the outside diameter of the connector. Therefore, the clearance between the cable and the inside diameter of the connector had to be kept within a relatively small range so that at least every two cable sizes required its own connector.

Processes 900 and 1000 moves only the contact element and a small amount of connector material to hold the contact in place. Thus, the size of the cable can vary widely and a variety of different size cables can be used with the same connector.

It will be understood that various modifications may be made. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

The invention claimed is:

1. A connector system comprising:

a member having a surface with an opening in the surface and an open end defined by one or more walls, wherein the walls include a first end attached to the surface and a second end having a notch;

a contact element defined by a passage in an axial direction and an opening that is perpendicular to the passage, wherein the contact element is sized to fit within the open end of the member such that the notch in the second end of the walls aligns with the passage in the contact element; and a probe element connectable to the opening in the surface of the member and the opening of the contact element;

wherein the probe element includes an end that terminates within the contact element passage or the contact element opening.

2. The system of claim 1 wherein the notch forms a U-shaped notch.

3. The system of claim 2 wherein the notch forms a V-shaped notch.

4. The system of claim 1 wherein the opening in the contact element is threaded to receive the probe element.

5. The system of claim 1 wherein:

the probe element includes a main portion and a threaded portion with the threaded portion having a diameter smaller than the main portion, the threaded portion is inserted through the opening in the surface of the member, and the main portion mates with the surface of the member.

6. The system of claim 1 wherein the member, the contact element, and the probe element are made of electrically conductive material.

7. The system of claim 1 wherein the passage in the contact element is sized to accept a variety of different sizes of cable.

8. The system of claim 1 further comprising a terminator having an opening to receive the member, the contact element, and the probe element.

9. The system of claim 1 wherein the probe element includes a contact pad and a threaded portion, wherein the contact pad is attached to the end of the threaded portion of the probe element.

10. A method for securing a cable in a connector system to form multiple current carrying paths, the method comprising:

receiving a cable through a passage in a contact element and an open end of a member defined by one or more walls, wherein the walls include an end having a notch;

inserting a probe element through an opening in the member and an opening in the contact element that is perpendicular to the passage; and rotating the probe element to move the contact element and the member together to capture the received cable between the passage in the contact element, the notch in the open end of the member, and an end of the probe element to form multiple current carrying paths.

11. The method as in claim 10 wherein the contact element, the probe element, and the member are made of electrically conductive material.

12. The method as in claim 10 wherein inserting the probe element includes threading the probe element through the opening in the contact element.

13. The method as in claim 10 wherein the notch includes a U-shaped notch.

14. The method as in claim 10 wherein the notch includes a V-shaped notch.

15. A connector system, comprising:

a connector having an inner surface defined by a passage in an axial direction, the connector including one or more openings that are perpendicular to the passage;

one or more contact elements disposed to fit through the openings of the connector to capture a cable inserted in the passage of the connector between edges of the contact elements and the inner surface of the connector; and a current interchange between the connector and another electrical device, wherein the current interchange includes a bolt opening.

16. The system of claim 15 wherein the inner surface includes one or more cuts opposite the openings.

17. The system of claim 15 wherein at least one of the contact elements has a notch on one side.

18. The system of claim 17 wherein the notch includes a U-shaped notch.

19. The system of claim 17 wherein the notch includes a V-shaped notch.

20. The system of claim 17 wherein an inside diameter of the notch and an inside diameter of the inner surface of the connector are about the same diameter.

21. The system of claim 15 wherein the contact elements are about the same size as the openings in the connector.

22. The system of claim 15 wherein the contact elements are tapered and include a portion that is larger than the openings in the connector.

23. The system of claim 15 further comprising one or more bolts to drive the contact elements through the openings of the connector and across the passage of the connector to capture the cable.

24. The system of claim 23 wherein:

the openings of the connector are threaded; and the bolts include threads having one or more tapered undercuts in the threads.

25. The system of claim 15 further comprising a hydraulic die or a manual tool to drive the contact elements through the openings of the connector and across the passage of the connector to capture the cable.

26. The system of claim 25 wherein the contact elements are tapered to lock the contact elements in place.

27. The system of claim 15 wherein the connector is sized to accept a variety of different sizes of cable.

28. A method for securing a cable in a connector system, the method comprising:

receiving a cable through a passage in an axial direction of a connector;

inserting one or more contact elements through one or more threaded openings of the connector that are perpendicular to the passage; and inserting one or more threaded bolts into the threaded openings of the connector to drive the contact elements across the passage of the connector to capture the received cable.

29. The method as in claim 28 wherein the threaded bolts include a tapered undercut to shear the bolts at the undercut.

30. The method as in claim 28 wherein at least one of the contact elements includes a notch.

31. The method as in claim 30 wherein the notch is a U-shaped notch.

32. The method as in claim 30 wherein the notch is a V-shaped notch.

33. The method as in claim 30 wherein an inside diameter of the notch and an inside diameter of an inner surface of the connector are about the same diameter.

34. A method for securing a cable in a connector system, the method comprising:

receiving a cable through a passage in an axial direction of a connector;

inserting one or more contact elements through one or more openings of the connector that are perpendicular to the passage;

using a hydraulic die or a manual tool to drive the contact elements through the opening of the connector and across the passage of the connector to capture the cable; and connecting the connector to another electrical device through a bolt opening of a current interchange.

35. The method as in claim 34 wherein using the hydraulic die or the manual tool includes using the hydraulic die or the manual tool to apply force to the contact elements and only a portion of the connector.

36. The method as in claim 34 wherein at least one of the contact elements includes a notch.

37. The method as in claim 36 wherein the notch is a U-shaped notch.

38. The method as in claim 36 wherein the notch is a V-shaped notch.

39. The method as in claim 36 wherein an inside diameter of the notch and an inside diameter of an inner surface of the connector are about the same diameter.

* * * * *